US005096273A

United States Patent [19]

Alexander et al.

[11] Patent Number: 5,096,273

[45] Date of Patent: Mar. 17, 1992

[54] APPARATUS FOR STORING AND DISPLAYING SIMULATED FURNITURE

[75] Inventors: David E. Alexander; Daniel D. Bailey, both of Lincoln, Ill.

[73] Assignee: Lincoln Office Supply Co., Incorporated, Peoria, Ill.

[21] Appl. No.: 695,408

[22] Filed: May 3, 1991

[51] Int. Cl.[5] ..... A47B 53/00

[52] U.S. Cl. ..... 312/198; 312/204

[58] Field of Search ..... 312/198, 204

[56] References Cited

U.S. PATENT DOCUMENTS 4,080,022 3/1978 Canfield et al. ..... 312/198 X

*Primary Examiner*—Joseph Falk

*Attorney, Agent, or Firm*—Emrich & Dithmar

[57] ABSTRACT

Apparatus for storing and displaying simulated furniture for an office or the like including a plurality of cabinets for storing and displaying a plurality of reduced scale furniture members, each being proportioned to simulate an actual full scale furniture member such as a desk, a chair, a wall panel, etc. The simulated furniture members have different colors, fabrics, finishes, textures, etc., and are stored side-by-side in the cabinets to permit an observer to view a plurality of the furniture members simultaneously. A display fixture, including selected simulated furniture members removed from the cabinets, allows an observer to view, compare and evaluate different combinations and relationships of color, texture, fabric, finish, etc., of the various simulated furniture members in the proportion and form of an arrangement including full scale furniture members.

10 Claims, 5 Drawing Sheets

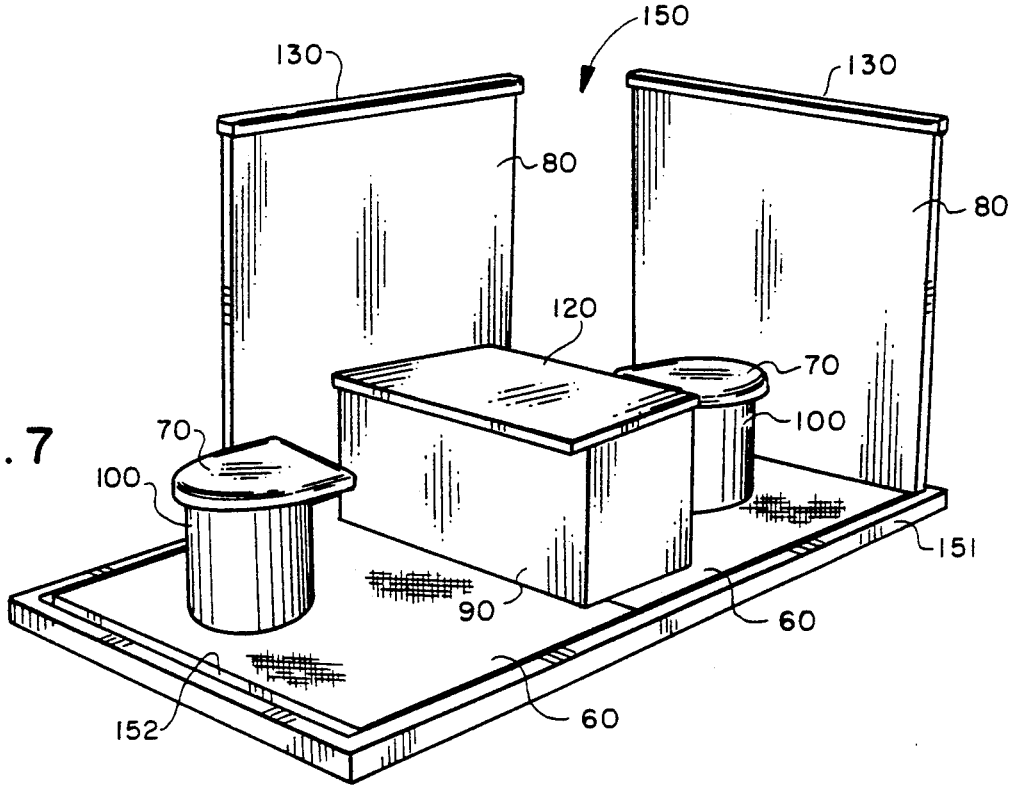
FIG. 7
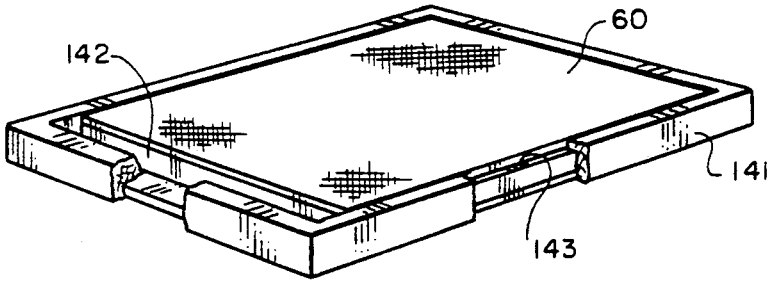
FIG. 8
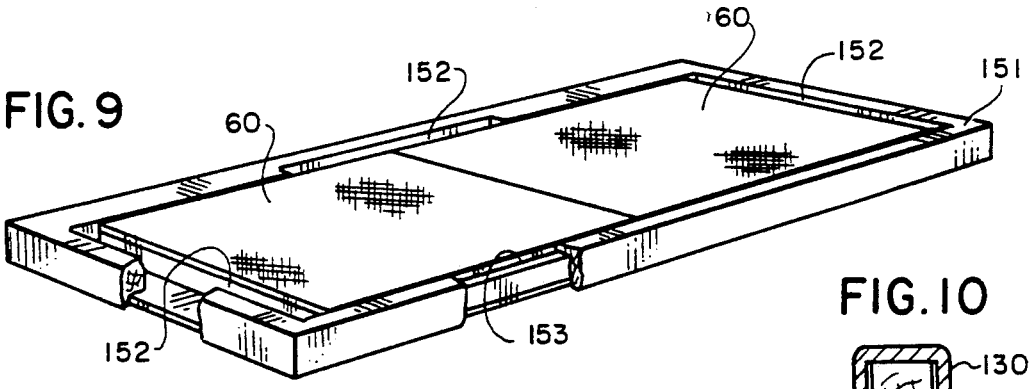
FIG. 9
FIG. 10
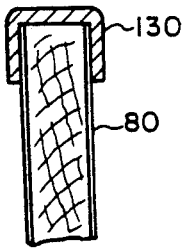

APPARATUS FOR STORING AND DISPLAYING SIMULATED FURNITURE

FIELD OF THE INVENTION

The present invention relates to apparatus for storing and displaying simulated furniture members and, more particularly, to apparatus including a cabinet system for storing and displaying a plurality of simulated furniture members and a fixture for displaying furniture components selected individually from the storage cabinets to assemble and simulate a full scale furniture arrangement for an office or the like.

BACKGROUND OF THE INVENTION

An individual seeking to decorate or refurnish a room such as an office or the like usually desires, before making a purchase, to view the various combinations and relationships of form, color, fabric, texture and finish of the various furniture components such as carpeting, wall paneling, desk, chairs, etc., which will comprise the office or the like. Moreover, in the case where a designer has arrived at some suggestions for the potential office user, it is difficult to simulate the look and feeling of the finished office. Renderings often are not satisfactory because the colors and texture seldom can be accurately portrayed.

Typically, the individual is allowed to evaluate the various combinations and relationships by viewing individual flat display squares comprising, for example, carpet squares, chair seat cover squares, wall paneling squares, desk finish squares, each of the squares having a different color, texture, finish, etc. These flat display squares are disadvantageous because they do not allow the individual to view the various finishes, fabrics, colors, etc. as they would appear in combination and arrangement on the actual furniture components. Further, they do not readily allow the observer to evaluate different furniture components having particular finishes, colors, fabrics, etc.

Alternatively, the individual is allowed to evaluate the various combinations and relationships by viewing a display of an office or the like including full scale furniture components. A disadvantage of full scale displays is the difficulty of changing the components and the prohibitive cost associated with having every full scale furniture component available in every color, finish, fabric, etc.

SUMMARY OF THE INVENTION

The present invention includes apparatus for storing and displaying simulated furniture components.

According to the present invention, the apparatus includes a plurality of interacting storage cabinets. A plurality of carpet tile members are stacked in a first cabinet having an open front for viewing and access. The carpet tiles, each carrying a section of carpeting having a different color or texture, may be stored on a shelf or in the drawer. Additionally, the first cabinet displays a plurality of chair seat simulating members, each of these members having a different finish or fabric.

A plurality of wall panel simulating members are stored in a second storage cabinet. The wall panel members, each having at least one side covered with a material of a different color or covering, are disposed upright in the cabinet in side-by-side relationship to allow an observer to view them simultaneously. The wall panels are slightly spaced for access.

A plurality of desk bases and chair seat simulating members are stored in a third cabinet. Each of the desk bases has a different color and each of the chair seats has at least one side covered with a material of selected color or fabric. The desk bases and chair seats are disposed in the third cabinet in side-by-side relationship to permit an observer to view them simultaneously for selection.

A display fixture permits the simulated furniture components selected from the cabinets by an observer, designer or salesperson to be placed in a realistic arrangement. The fixture includes a flat base having a slot for receiving a selected wall panel member in a vertical position and a receptacle for receiving a selected carpet tile member in a horizontal position adjacent the wall panel. A selected desk base and chair base combination are placed on top of the carpet tile, and a selected desk top and chair seat are positioned on top of the desk base and chair base, respectively. A painted metal "C" channel is placed horizontally across the top of the simulated wall panel.

The fixture permits a customer or designer to observe, discuss and evaluate individual combinations of and relationships between the different fabrics, colors, textures, and finishes of the various furniture components as they would appear in a full scale furniture arrangement for an office or the like. It also permits the user to change the combination readily. With the cabinets close at hand, the observer is permitted to substitute furniture components at will to study and evaluate different combinations. The overall storage system also has the advantage of storing all the various components of an office furniture showroom in designated locations so that different sales personnel or users may use the facility without having to locate the components from the place where the last user may have left them.

The features and advantages of the present invention will be more fully appreciated after a better understanding is obtained of the invention from the attached drawing wherein identical reference numerals refer to like parts in the various views.

BRIEF DESCRIPTION OF THE DRAWINGS

FIG. 7 is a perspective view of another embodiment of a fixture for displaying selected simulated furniture members;

FIG. 8 is a broken perspective view of the base of the fixture in FIG. 6;

FIG. 9 is a broken perspective view of the base of the fixture in FIG. 7; and FIG. 10 is a partial vertical cross-section of a wall panel and top cap simulating member, taken along line 10—10 of FIG. 6.

DETAILED DESCRIPTION OF THE PREFERRED EMBODIMENT

Although the present invention has broader applicability, as persons skilled in the art will appreciate, the embodiment illustrated herein is a system for use in storing and displaying office furniture.

Figure 1:
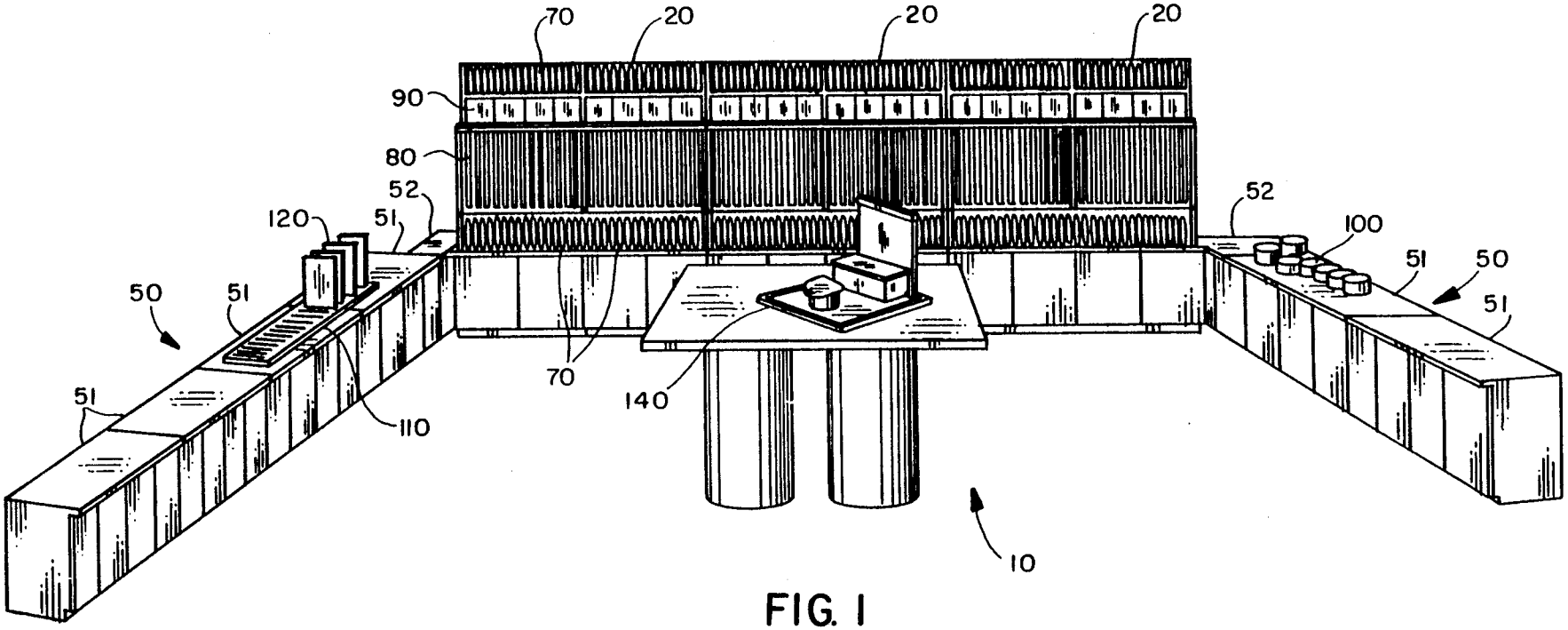
FIG. 1 is an upper, frontal perspective view of the apparatus for storing and displaying simulated furniture members of the present invention.
Figure 2:
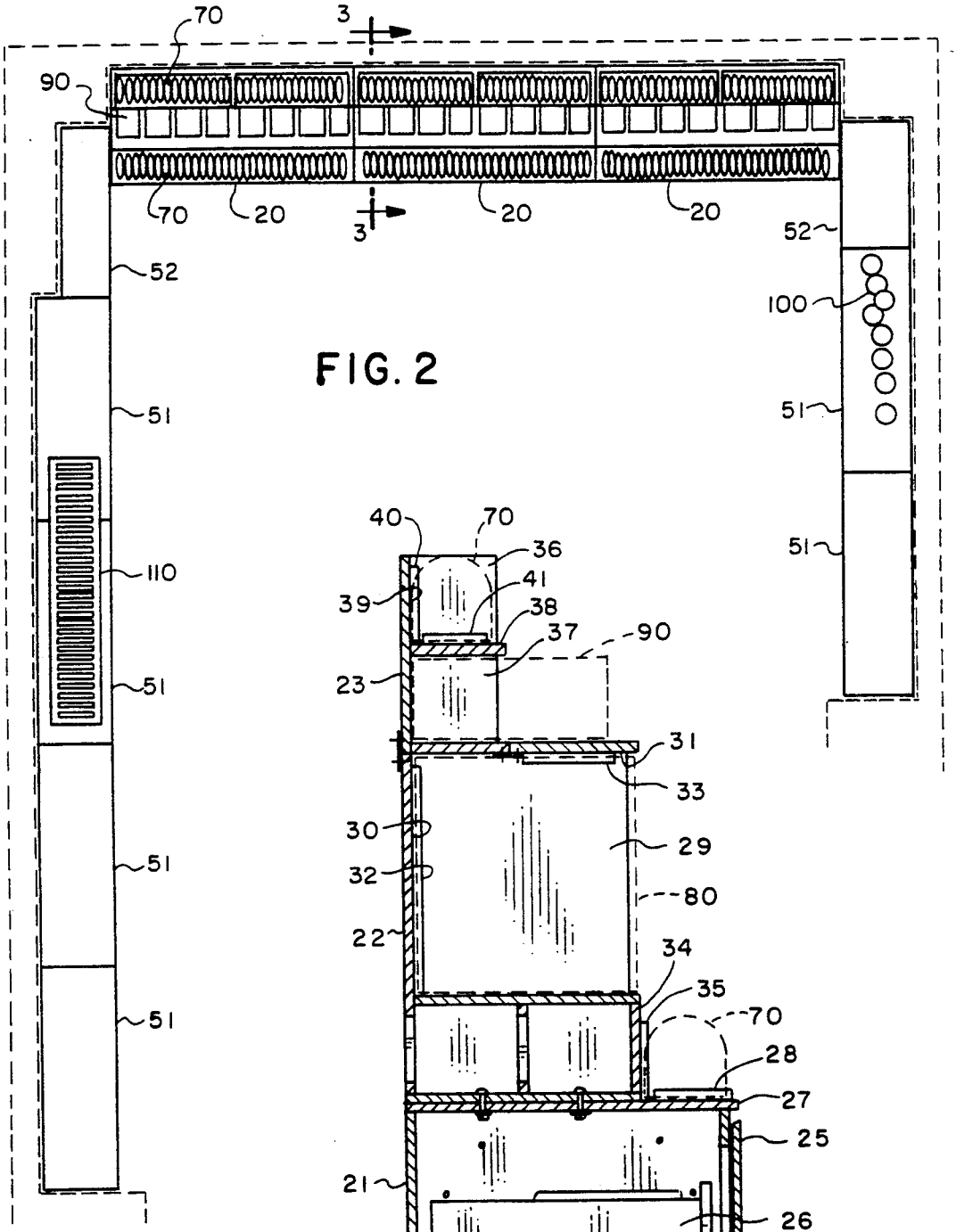
FIG. 2 is a plan view of the apparatus of FIG. 1.

Apparatus for storing and displaying simulated furniture members according to the present invention, generally designated 10, is shown in FIGS. 1 and 2. The apparatus 10 is adapted to be located in a room of suitable size, the walls thereof being outlined in FIG. 2.

Figure 3:
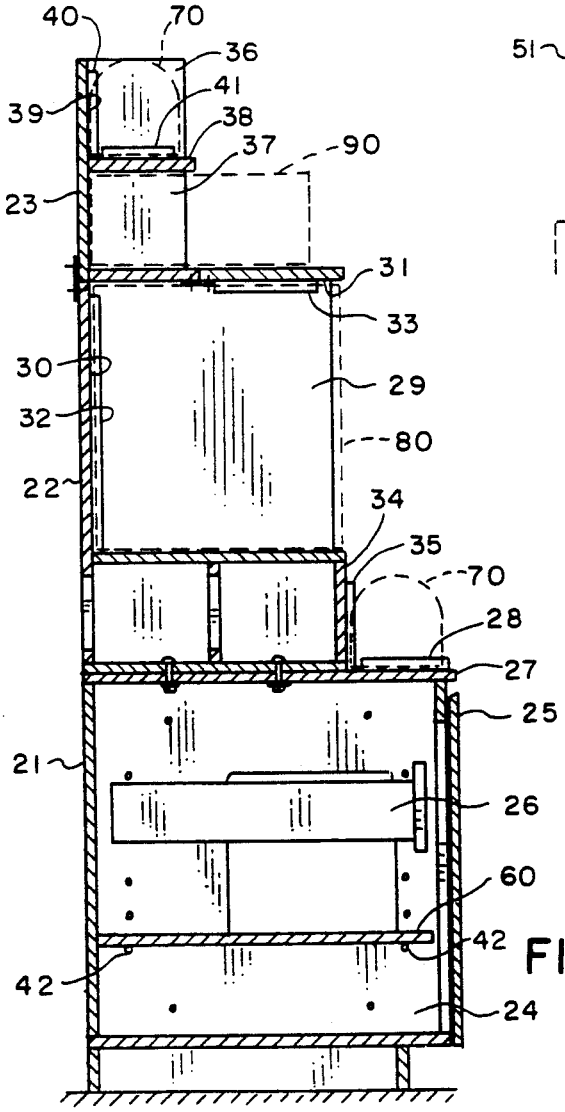
FIG. 3 is a vertical cross-section of the center storage cabinets, taken along the line 3—3 of FIG. 2.
Figure 4:
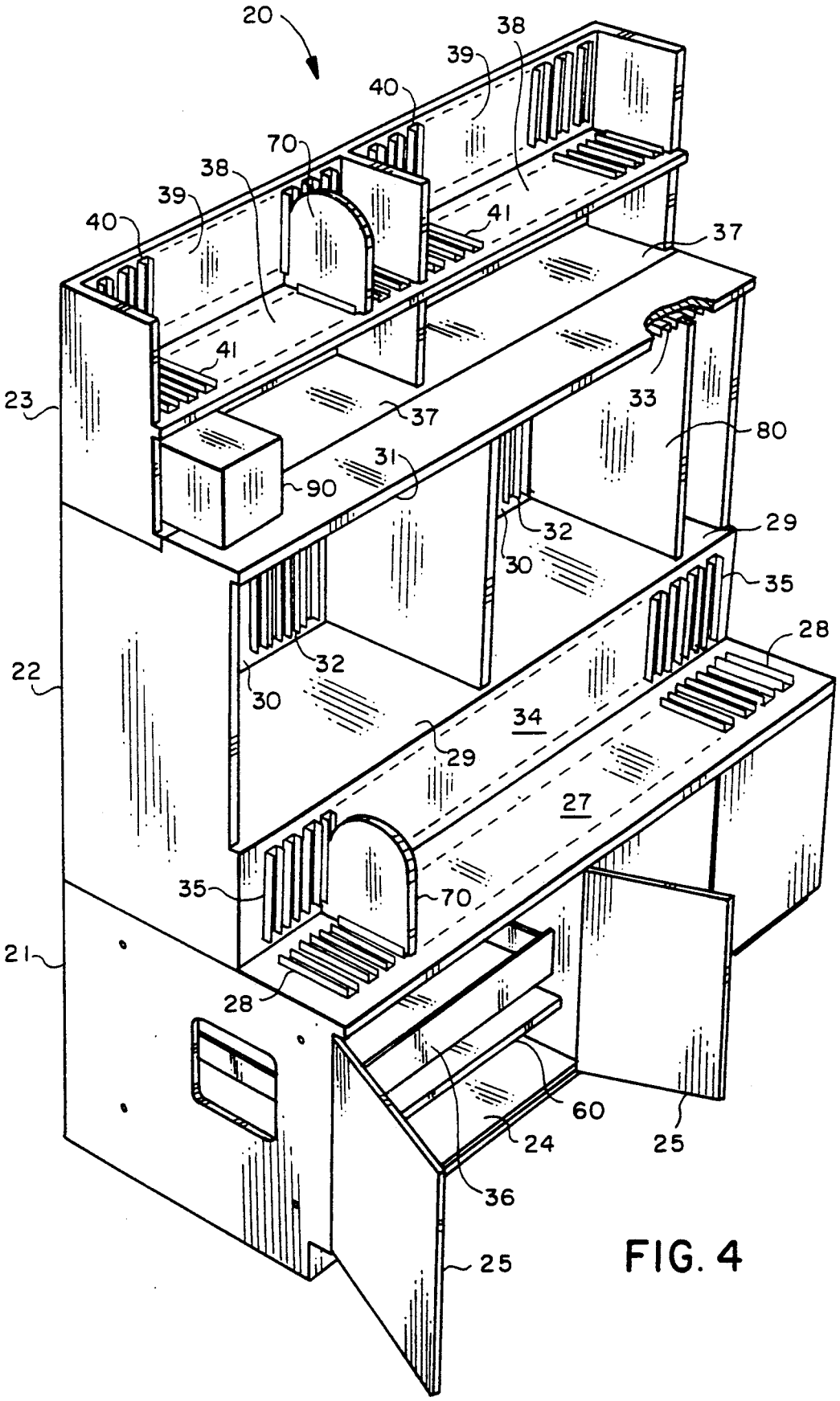
FIG. 4 is a perspective view of the center storage cabinets.

The apparatus 10 includes a plurality of center cabinets 20 and side cabinets 50. Referring to FIGS. 3 and 4, each of the center cabinets 20 of the illustrated embodiment includes a base cabinet 21, a middle cabinet 22 and a top cabinet 23.

The base cabinet 21 includes two inner compartments 24, each having two swing-out doors 25. A full-extension drawer 26 is disposed within each of the compartments 24. Also disposed within each of the compartments 24 is an adjustable shelf 60 supported by shelf clips. The shelf clips can be inserted in holes at various levels. Cabinets 21 also include a top 27 having a plurality of aluminum channels 28 secured to the upper surface thereof and aligned thereon in side-by-side relationship.

The middle cabinet 22 is mounted to the top 27 of the cabinet 21 by conventional means. The cabinet 22 includes two open compartments 29, each having a back wall 30 and a top wall 31 to which are secured a plurality of elongated aluminum channels 32 and 33, respectively. Individual channels 32 and 33 are aligned with each other to form a series of holders for wall panel members 80 stored upright in side-by-side relation. It is understood that there are sufficient channels 32 and 33 to form holders in the entire space between opposite sides of the compartments 29. The cabinet 22 also includes a partial front wall 34 extending along the lower portion only and having elongated aluminum channels 35 secured to the outer surface in side-by-side relationship. The channels 35 are aligned with the channels 28 on the display top 27 to form holders for simulated chair seats 70. As indicated by dashed line in FIG. 4, the seat holders may be placed to fill the width of the cabinet.

The top cabinet 23 is mounted to the top of the middle cabinet 22. The cabinet 23 includes two adjacent upper compartments 36 and two adjacent lower compartments 37 separated by a horizontal shelf 38 and sharing a common back wall 39 to which are secured a plurality of vertical channels 40 in side-by-side relationship. The channels 40 are aligned at right angles with corresponding channels 41 mounted to the upper surface of the shelf 38 to store chair seats 70.

Referring to FIGS. 1 and 2, the side cabinets 50 include floor level cabinets 51 identical in structure to the base cabinet 21 and two cabinets 52 which fill the void in the corners.

Returning to FIGS. 3 and 4, the compartments 24 in the bottom cabinets 21 are adapted for storing a plurality of horizontal carpet tile members 60 in a stack. Each of the carpet tile members 60 carries a section of carpeting of different color or texture. The carpet tile members 60 are seated on top of the adjustable shelf 60 or in the drawer.

Referring to FIGS. 1–4, a plurality of chair seat simulating members 70, each comprised of a piece of plywood covered with foam and then covered with a material corresponding to one of the available chair seat fabrics or leathers, are supported on the top 27 of the cabinet 21. The chair seats 70 are proportioned to simulate an actual full scale chair seat. The seats 70 are held in spaced, side-by-side relation in the channel holders described to permit an observer to view a number of them simultaneously.

Additional chair seats 70 are stored in the compartments 39 in the cabinet 23 and; more particularly, they are secured side-by-side in the aligned channel holders 40 and 41 to permit an observer to view them simultaneously.

Referring now to FIGS. 1, 3 and 4, a plurality of wall panel simulating members 80, each comprised of a piece of plywood covered with foam and then covered with a material corresponding to one of the available wall panel fabrics, is stored in the compartments 29 in the cabinet 22, and more particularly, they are stored vertically in side-by-side relation within aligned channels 32 and 33 therein to permit an observer to view a plurality of the wall panels 80 simultaneously. Each of the panels 80 is constructed to simulate a wall panel. The wall panel members 80 may also be stored in the compartment 24 of the cabinets 21 and 51 in the same manner that the carpet tile members 60 are stored therein.

A plurality of desk base members 90, each comprised of a rectangular solid made from particle board or the like and painted in one of the available desk colors, are stored side-by-side in the compartments 37 of the cabinet 23 to permit an observer to view a plurality of the members 90 simultaneously. Each of the members 90 is proportioned to simulate a desk.

Referring to FIGS. 1 and 2, a plurality of chair base simulating members 100, each comprised of a cylindrical solid made from plywood or the like and painted in one of the available chair base colors, are stored and displayed on top of the side cabinets 51 to permit an observer to view a plurality thereof simultaneously. Each of the chairs 100 is designed to simulate visually the base of a chair.

Figure 5:
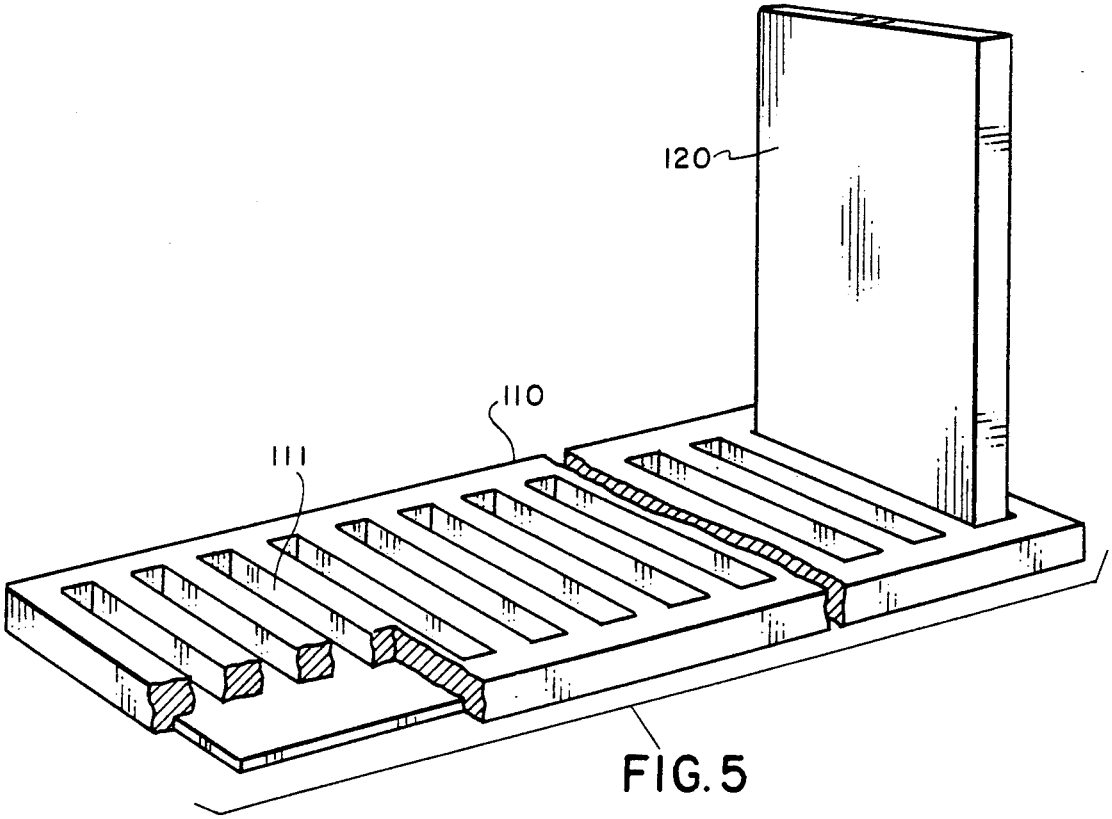
FIG. 5 is a broken perspective view of a storage and display fixture for a plurality of desk top simulating members.

Referring to FIGS. 1 and 5, a display fixture 110, having a plurality of parallel slots 111, is seated on top of one of the cabinets 51. The slots 111 receive and hold a plurality of desk top simulating members 120, respectively. Each of the tops 120 is comprised of a rectangular solid made from particle board or the like covered with one of the available laminates or wood veneers. Each of the tops 120 is designed to simulate the top of an office desk.

Figure 6:
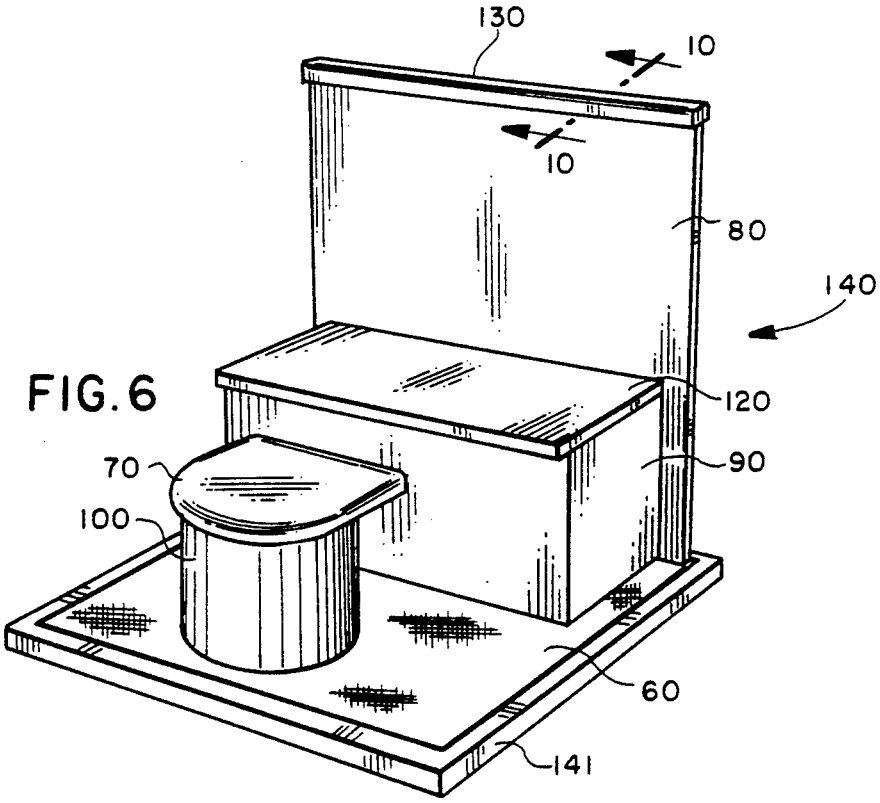
FIG. 6 is a perspective view of a fixture for displaying selected simulated furniture members.

A plurality of top cap members, one such member 130 being shown in FIGS. 6 and 10, is adapted to be secured to the top of the wall panel simulating members 80. Each of the top cap members 130 is a C-shaped channel proportioned to simulate top cap for a wall separator panel. The top cap members 130 are stored in the drawers 26 of the cabinets 21 and 51.

Each of the simulating furniture components is approximately one-quarter the size of the actual full scale furniture components.

Referring to FIGS. 6 and 8, the system 10 further comprises a fixture 140 for displaying the simulated furniture components described above in a realistic combination and arrangement. The fixture 140 includes a base 141 having a slot 142 adjacent one edge (or two) for receiving a selected wall panel 80 and holding it in a vertical position. The fixture includes a receptacle 143 for receiving a selected carpet tile member 60 in a horizontal position. A chair base simulating member 100 and accompanying chair seat simulating member 70 and a desk base simulating member 90 and accompanying desk top simulating member 120 may be arranged as shown in FIGS. 1 and 6. A top cap member 130 is placed on the top of the selected wall panel 80. Referring to FIG. 1, the fixture 140 may be seated on a table or the like in the center of the viewing room.

Referring to FIGS. 7 and 9, the system 10 may also include a fixture 150 including a base 151 having three slots 152, each being adapted to receive a wall panel 80 in a vertical position. The fixture 150 also includes a receptacle 153 for receiving two selected carpet tiles 60 in a horizontal position. Further, the fixture 150 includes two selected chair bases 100, each having an accompanying chair seat simulating member 70, and a selected desk base 90 with an accompanying desk top 120. A selected top cap member 130 is placed on each of the wall panel members 80.

According to the invention, the fixtures 140 and 150 simulate, at approximately one-quarter scale, the actual full scale arrangement of furniture components for an office or the like. Thus, the fixtures allow an observer to study all of the colors, fabrics, finishes, textures, etc., of various furniture components in a proposed office or work station arrangement in the proportion and form of an actual full scale furniture arrangement. The plurality of cabinets allow the observer to study simultaneously all of the simulated furniture members in their various colors, finishes, textures, etc., and to substitute any and all of the selected simulated furniture members in the display fixtures with different furniture members from the cabinets so that other combinations of furniture members may be studied and evaluated.

Having thus disclosed in detail a preferred embodiment of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

We claim:

1. Apparatus for storing and displaying simulated furniture members in a desired combination and arrangement comprising:

a first storage cabinet;

a plurality of carpet tile members stored in spaced relation in said first cabinet, each of said carpet tile members including a section of carpet of selected color or texture;

a second storage cabinet;

a plurality of wall panel simulating members stored in spaced relation in said second cabinet, each of said wall panel members having at least one side covered with a material of different color or fabric, each of said wall panel members being stored in side-by-side, spaced relationship to permit an observer to view a plurality of said wall panel members simultaneously;

a third storage cabinet;

a plurality of desk base simulating members stored in said third cabinet, each of said desk base members having a selected color, each of said desk base members being stored to permit an observer to view a plurality of said desk base members simultaneously;

a plurality of chair seat simulating members stored in said third cabinet in spaced side-by-side relation, each of said chair seat members having a material of selected color or fabric; and at least one fixture for displaying simulated furniture members selected from said cabinets, said fixture including a flat base member having a slot adjacent an edge for receiving a selected one of said wall panel members and holding said panel member in a vertical position, and means for receiving a selected one of said carpet tile members in a horizontal position so that a selected one of said desk members and chair members may be placed on said selected carpet tile member to display a simulated furniture arrangement.

2. The apparatus of claim 1, further including a second plurality of chair seat simulating members stored on top of said first storage cabinet, each of said chair seat members being stored in said first cabinet in spaced side-by-side relationship to permit an observer to view a plurality of said chair seat members simultaneously.

3. The apparatus of claim 1, wherein said third cabinet includes first and second compartments, said first compartment having a plurality of channels, said chair seat members being disposed respectively in said plurality of said channels and said plurality of desk base members being disposed in said second compartment.

4. The apparatus of claim 2, wherein said first cabinet includes a display top having a plurality of channel holders and said chair seat members being secured respectively in said channel holders on said display top.

5. The apparatus of claim 1, wherein said second cabinet includes a compartment having a second plurality of channel holders, a plurality of said wall panel members being disposed respectively within said second channel holders.

6. The apparatus of claim 1, further comprising a fourth cabinet for storing a plurality of carpet tile members and wall panel members and for displaying a plurality of chair and desk top members.

7. The apparatus of claim 1, wherein said fourth cabinet includes a display top and said plurality of chair members being displayed on said display top.

8. The apparatus of claim 1, further comprising a plurality of desk top members, each of said desk top members being stored in said cabinet display means in spaced, side-by-side relation to permit an observer to view a plurality of said desk top members simultaneously.

9. The apparatus of claim 8, further including a second fixture including a plurality of parallel slots, said plurality of said desk top members being positioned respectively in said plurality of slots.

10. The apparatus of claim 1, further comprising a plurality of top cap simulating members, each of said top cap members having a different finish or color, each top cap member being arranged to be received on top of a selected one of said wall panel members in said display fixture.

* * * * *